US009867455B1

(12) United States Patent
Merton, Sr.

(10) Patent No.: US 9,867,455 B1
(45) Date of Patent: Jan. 16, 2018

(54) MICROPHONE HOLDER

(71) Applicant: David M. Merton, Sr., Bedford, TX (US)

(72) Inventor: David M. Merton, Sr., Bedford, TX (US)

( * ) Notice: Subject to any disclaimer, the term of this patent is extended or adjusted under 35 U.S.C. 154(b) by 74 days.

(21) Appl. No.: 14/697,485

(22) Filed: Apr. 27, 2015

Related U.S. Application Data

(63) Continuation-in-part of application No. 14/267,907, filed on May 1, 2014, now abandoned.

(60) Provisional application No. 61/818,105, filed on May 1, 2013.

(51) Int. Cl.
*A45F 5/02* (2006.01)
*H04R 1/08* (2006.01)

(52) U.S. Cl.
CPC *A45F 5/02* (2013.01); *H04R 1/08* (2013.01)

(58) Field of Classification Search
CPC ..... H04R 1/08; H04R 1/028; H04R 1/083; A45F 5/02; A45F 2005/002; A45F 2005/006; A45F 2005/008; A45F 2005/026; A45F 2200/0516; A45F 5/00; A45F 5/021; A42B 1/244; A43B 5/14; B25H 3/006; B43K 25/02; B62M 3/083; B67B 7/16; F16B 2/245; F16B 9/023; F21L 4/027; F21V 21/0885
USPC ..... 24/3.1, 3.7, 3.11, 3.12
See application file for complete search history.

(56) References Cited

U.S. PATENT DOCUMENTS 4,040,547 A * 8/1977 Dickey ..... F16M 13/04 224/247
4,473,269 A * 9/1984 Belttary ..... H01H 71/08 439/839
4,870,873 A * 10/1989 Tackles ..... A43B 5/14 74/594.6
5,460,346 A * 10/1995 Hirsch ..... A45F 5/02 224/272
5,651,522 A * 7/1997 Davis ..... B42F 1/02 248/221.11
D446,547 S * 8/2001 Nagel ..... D19/197
6,757,401 B2 * 6/2004 Uchimura ..... H04R 1/08 248/309.1
D642,621 S * 8/2011 Keum ..... D19/197
8,171,602 B1 * 5/2012 Zauhar ..... A45F 5/00 131/178
8,175,314 B1 * 5/2012 Webster ..... H04R 1/028 381/122
2008/0237282 A1 * 10/2008 Sin ..... A45F 5/02 224/197
2011/0000054 A1 * 1/2011 Trifari, Jr. ..... B65F 1/1468 24/457
2014/0007409 A1 * 1/2014 Trifari, Jr. ..... B65F 1/1468 29/525.01

* cited by examiner

*Primary Examiner* — Robert Sandy
*Assistant Examiner* — David M Upchurch
(74) *Attorney, Agent, or Firm* — Mark H. Plager

(57) ABSTRACT

A microphone holder is configured to join a microphone to a shirt. The microphone holder has a back panel configured to fit within one of a set that includes a concealable vest and an outer carrier or a plate carrier. A top panel is smoothly connected to the back panel. The top panel further includes a top window. The top window is adapted to receive a clip on the microphone. A front panel is smoothly connected to the top panel. The front panel is offset from the back panel in order to fit over the shirt.

9 Claims, 4 Drawing Sheets

MICROPHONE HOLDER

RELATED APPLICATION

This application is a continuation-in-part of U.S. Non-provisional patent application Ser. No. 14/267,907 filed on May 1, 2014. That application in turn claims priority to provisional patent application U.S. Ser. 61/818,105 filed on May 1, 2013. The entire contents of all of these applications are herein incorporated by reference.

BACKGROUND

The embodiments herein relate generally to clothing accessories.

Prior to the disclosed invention, portable microphones were mounted to a police officer's epaulet or front of shirt. As a result, some officers could not be heard well because they kept the microphone on one's shoulder. Further, officers had to turn their head to talk toward the microphone, which took one's eyes off of one's focal point, which could be dangerous. If an officer could not use one's hands, for instance when using both hands with a suspect or if injured, the officer could not activate the microphone. Additionally, the shoulder mounted microphone came with a cord of sufficient length to choke the officer if the cord was engaged by a suspect. In a fight, foot pursuit or strenuous activity, the microphone would become detached and was useless. The present invention solves these problems.

SUMMARY

A microphone holder is configured to join a microphone to a shirt. The microphone holder has a back panel configured to fit within one of a set consisting of: a concealable vest and an outer carrier. A top panel is smoothly connected to the back panel. The top panel further comprises a top window. The top window is adapted to receive a clip on the microphone. A front panel is smoothly connected to the top panel. The front panel is offset from the back panel in order to fit over the shirt.

In some embodiments, the back panel is joined to one of the set consisting of: the concealable vest and the outer carrier; with a hook and loop fastener. In some embodiments, the top window is arranged to be ⅞ inch by ½ inch.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
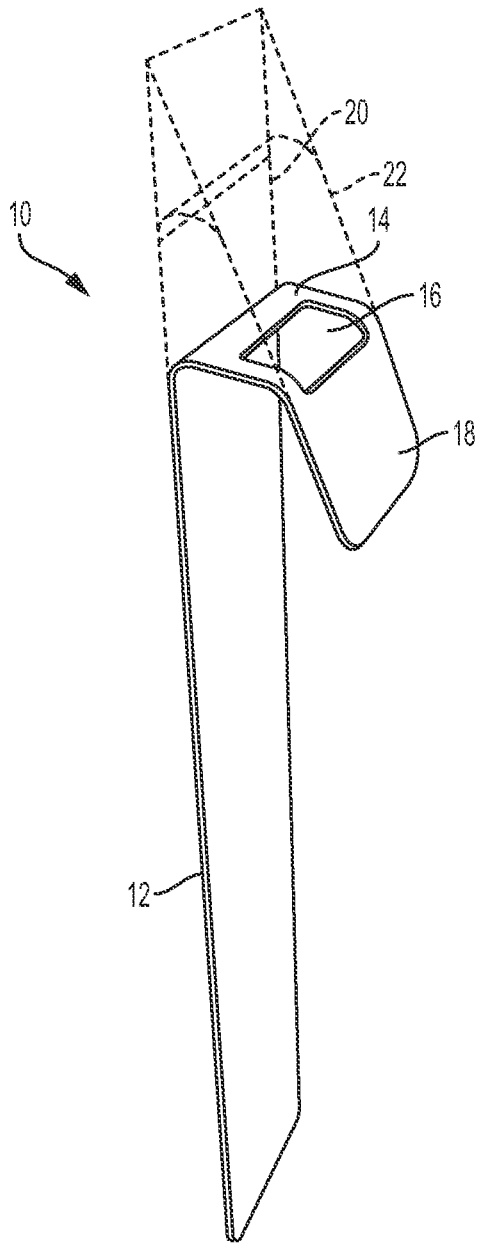
FIG. 1 shows a perspective view of one embodiment of the present invention.
Figure 2:
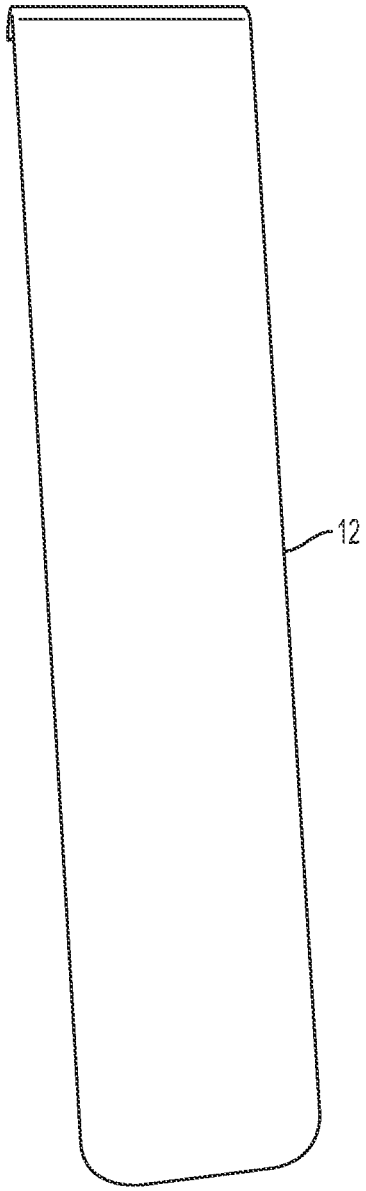
FIG. 2 shows a rear view of one embodiment of the present invention.
Figure 3:
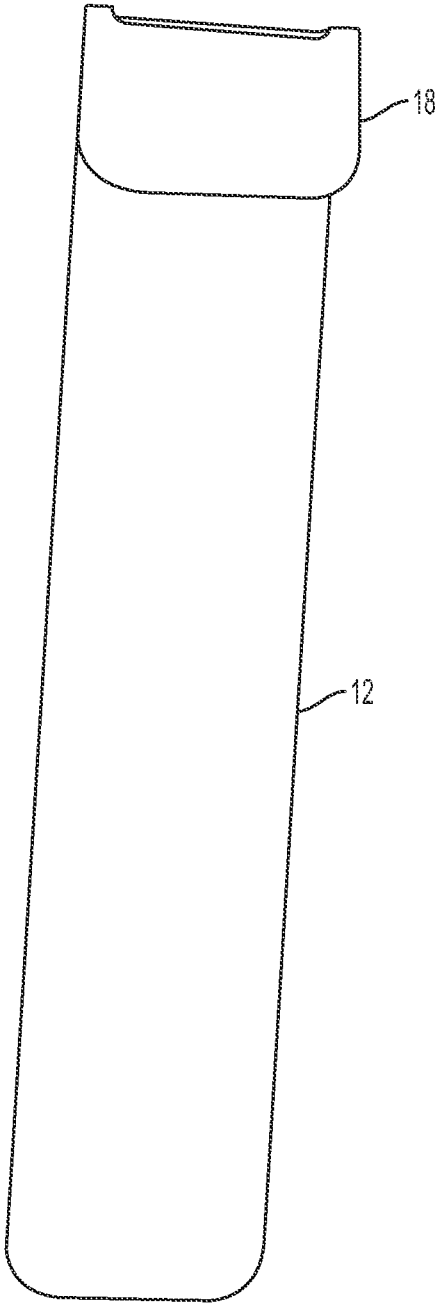
FIG. 3 shows a front view of one embodiment of the present invention.

By way of example, and referring to FIG. 1, FIG. 2 and FIG. 3 one embodiment of microphone holder 10 comprises back panel 12 which is molded into top panel 14. Top panel 14 further comprises top window 16. Top panel 14 further bends into front panel 18.

Back panel 12 lies in back panel plane 20. Front panel 18 lies in front panel plane 22. Back panel plane 20 intersects front panel plane 22 at an angle that when measured from back panel plane 20 toward front panel plane 22 is in a range of 15 to 45 degrees. Preferably, the angle is about 30 degrees.

Figure 4:
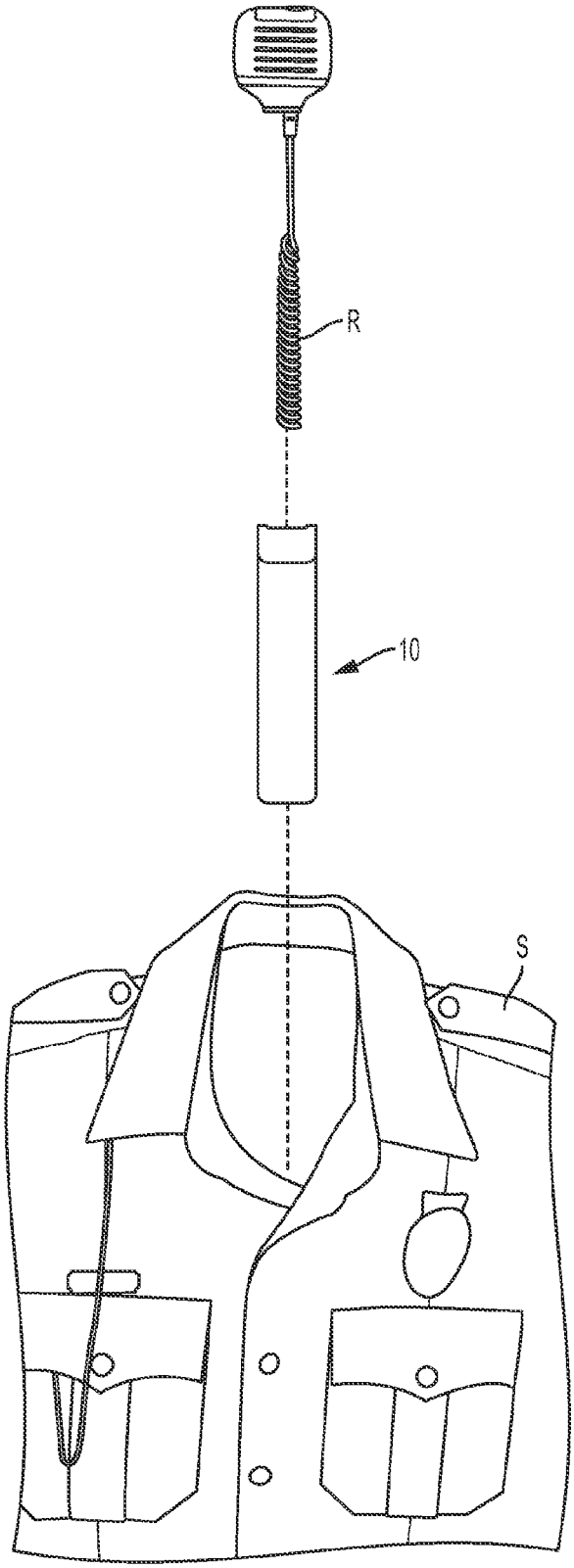
FIG. 4 shows a front view of one embodiment of the present invention in use.

There are two general contexts where microphone holder 10 would be used in conjunction with shirt S and radio R as shown in FIG. 4. In the first instance the user is wearing a concealable vest underneath shirt S. In this case a hook and loop fastener can be attached to back panel 12 in order to connect microphone holder 10 to a trauma plate pocket within the concealable vest underneath shirt S. In an alternate configuration, the human user is wearing an outer carrier, and since the outer carrier does not have a hook and loop fastener, a loop fastener needs to be sewn to the outer carrier, then a hook fastener can be taped onto a front panel to connect back panel 12 to the outer carrier.

An armor plate carriers with Modular Lightweight Load-carrying Equipment (MOLLE) attachments can have microphone holder 10 attached by attaching the loop fastener to the front of back panel 12. Then, weaving microphone holder 10 to through the MOLLE webbing and securing microphone holder 10 by attaching the hook fastener to the exposed loop fastener attached to holder 10

Because of these relatively narrow uses, there is a limited variety of dimensions that can be effective. Microphone holder 10 can be made from a piece of metal, plastic including the thermoplastic acrylic-polyvinyl chloride materials manufactured under trade name KYDEX® or acrylic-polyvinyl chloride manufactured under the trademark IPK® that is seven inches by one inch and is rectangular, top window can 16 be arranged to be ⅞ inch by ½ inch. These dimensions are critical to accommodate a clip on the back of the microphone so that the microphone cord is away from the user's head. Further, the microphone can now be activated with the human user's chin, providing a hands free mode to a push to talk technology. Once the piece of metal has been punched, the piece of metal can be bent with a metal break. After that, the metal piece can be smoothed, coated with paint and dried.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A microphone holder, configured to join a microphone to a vest; the microphone holder comprising:

a back panel configured to fit within one of a set consisting of: a concealable vest and an outer carrier; wherein the back panel lies in a back panel plane;

a top panel smoothly connected to the back panel;

a front panel, smoothly connected to the top panel; wherein the front panel is offset from the back panel in order to fit over the shirt; wherein the front panel lies in a front panel plane;

a top window, arranged centrally in the top panel and extending into a portion of the front panel; wherein the top window is adapted to receive a clip on the microphone;

wherein the back panel plane intersects the front panel plane at an angle that, when measured from back panel plane toward the front panel plane, is in a range of 15 to 45 degrees.

2. The microphone holder of claim 1, wherein the back panel is joined to one of the set consisting of: the concealable vest and the outer carrier.

3. The microphone holder of claim 2, wherein the top window is arranged to be ⅞ inch by ½ inch.

4. A microphone holder, configured to join a microphone to a vest; the microphone holder comprising:

a back panel configured to fit within one of a set consisting of: a concealable vest and an outer carrier;

a top panel smoothly connected to the back panel;

a front panel, smoothly connected to the top panel; wherein the front panel is offset from the back panel in order to fit over the shirt; wherein the front panel lies in a front panel plane;

a top window, arranged in the top panel and a portion of the front panel; wherein the top window is adapted to receive a clip on the microphone;

wherein the back panel is angled away from the top panel and the front panel is angled away further from the top panel.

5. The microphone holder of claim 4, wherein the back panel is joined to one of the set consisting of: the concealable vest and the outer.

6. The microphone holder of claim 5, wherein the top window is arranged to be ⅞ inch by ½ inch.

7. A microphone holder, configured to join a microphone to a shirt; the microphone holder comprising:

a back panel configured to fit within one of a set consisting of: a concealable vest and an outer carrier; wherein the back panel has a back panel top end and a back panel bottom end;

a top panel directly connected to the back panel;

a front panel, directly connected to the top panel; wherein the front panel is offset from the back panel in order to fit over the shirt; wherein the front panel lies in a front panel plane;

a top window, arranged in the top panel and a portion of the front panel; wherein the top window is adapted to receive a clip on the microphone;

wherein the back panel top end is proximate the front panel top end and the front panel bottom end angles away from the back panel bottom end.

8. The microphone holder of claim 7, wherein the back panel is joined to one of the set consisting of: the concealable vest and the outer.

9. The microphone holder of claim 8, wherein the top window is arranged to be ⅞ inch by ½ inch.

* * * * *